United States Patent [19]

Miller

[11] 4,078,589

[45] Mar. 14, 1978

[54] BATTERY DRIVEN SCREWDRIVER

[76] Inventor: Walter L. Miller, 6356 Costello, Van Nuys, Calif. 91401

[21] Appl. No.: 684,720

[22] Filed: May 10, 1976

[51] Int. Cl.[2] ..... B25B 23/00

[52] U.S. Cl. ..... 144/32 R; 310/50; 310/68 A

[58] Field of Search ..... 310/50, 68 A, 47, 68 B, 310/68 R; 144/32

[56] References Cited

U.S. PATENT DOCUMENTS 2,979,089 4/1961 Piesker ..... 144/32

FOREIGN PATENT DOCUMENTS 397,185 8/1931 United Kingdom ..... 144/32

*Primary Examiner*—Othell M. Simpson
*Assistant Examiner*—W. D. Bray
*Attorney, Agent, or Firm*—Robert E. Geauque

[57] ABSTRACT

A battery operated screwdriver wherein a battery and a motor assembly are mounted within an elongated housing, the motor operating a drive shaft extending from the housing, the drive shaft being off-set from the longitudinal center axis of the housing producing a weighted one longitudinal side of the housing, an operating switch assembly mounted within the housing, the operating switch assembly located along a longitudinal side of the housing which is opposite said one side.

5 Claims, 13 Drawing Figures

BATTERY DRIVEN SCREWDRIVER

BACKGROUND OF THE INVENTION

The field of this invention relates to tools and more particularly to a tool for driving screws or bolts.

In the field of construction of residences and buildings, there is a substantial amount of internal electrical wiring. This electrical wiring is placed within metal conduits with the wires being electrically connected to switches which are mounted within switch boxes. Normally, the electrical wires are joined together at a junction box. These junction boxes and switch boxes, as well as the metal conduits, are secured to the frame structure of the residence or building. This securement normally employs the use of long threaded bolts. To completely tighten one of these bolts it is not uncommon for fifty or more turns to be required of the bolt.

To manually tighten each of the bolts is a time consuming procedure and if the person does this tightening of the bolts manually, the procedure is slow, as well as being very tiring. The force required to tighten the bolts is not high, but the procedure is definitely tiring to a person's hand and arm.

There is a definite need for an electrically operated screwdriver which can be employed to tighten the aforementioned bolts for electrical equipment. Also, this device must be portable and be constructed in such a manner as to facilitate efficient use of the device and also, the device should be adaptable to inaccessible areas.

SUMMARY OF THE INVENTION

The structure of this invention is related to a battery operated screwdriver assembly which employs the use of a battery which is used to operate a motor through a switch assembly. This motor rotatably drives a drive shaft through a gearing assembly. This drive shaft is off-set from the longitudinal center axis of the housing. This drive shaft is to be connected to a tool head, such as the head of a screwdriver. The drive shaft can be separately locked if it is desirable to use the device of this invention manually in a high torque situation. A switch assembly can operate the drive shaft either clockwise or counterclockwise and a separate switch is employed that when depressed causes the device to be operated (in whatever direction of operation had been pre-established by the previously mentioned switch).

One of the objectives of the device of this invention is to provide a compact, portable, battery operated screwdriver which is light in weight and can be readily used in an efficient manner.

A further object of this invention is to construct the screwdriver in such a manner as to be readily useable in inaccessible locations.

A further object of this invention is to employ a locking device which upon being activated causes the device to be operated as a manual screwdriver and therefore adaptable to high torque situations, if a high degree of torque is needed.

A further object of this invention is that with the device placed on a planar supporting surface, that the device will always rest on one particular side and the switches which are located within the housing are located on a side opposite the aforementioned side so as to not likely come into contact with the planar supporting surface and cause accidental activation of the device.

DETAILED DESCRIPTION OF THE SHOWN EMBODIMENT

Figure 1:
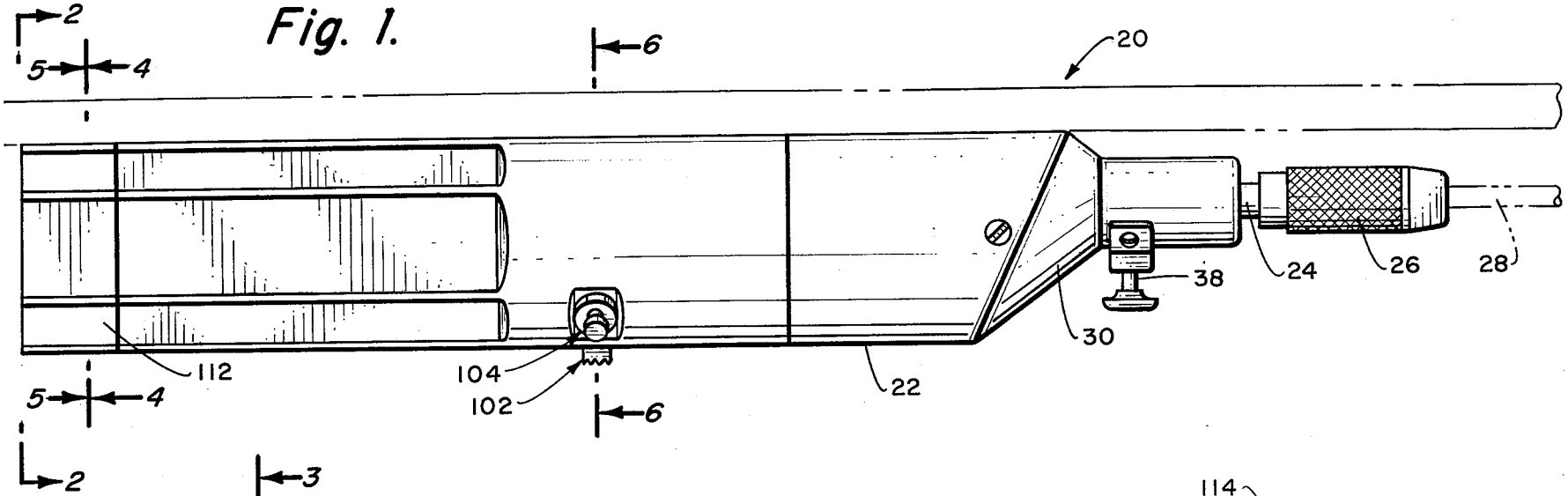
FIG. 1 is an elevational view of the screwdriver of this invention.
Figure 5:
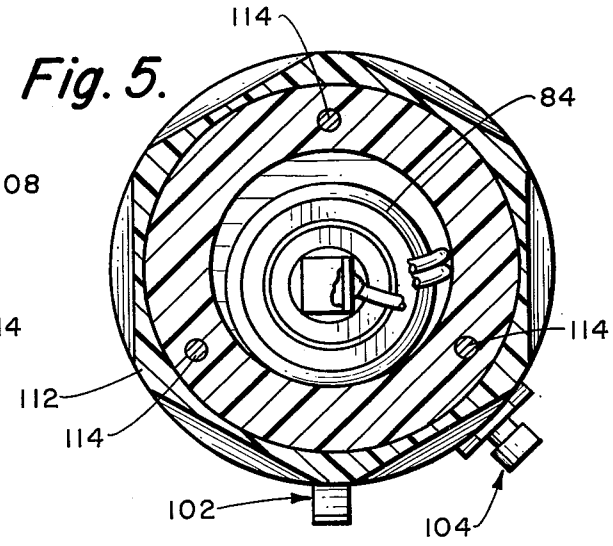
FIG. 5 is a cross-sectional view taken along line 5—5 of FIG. 1.
Figure 4:
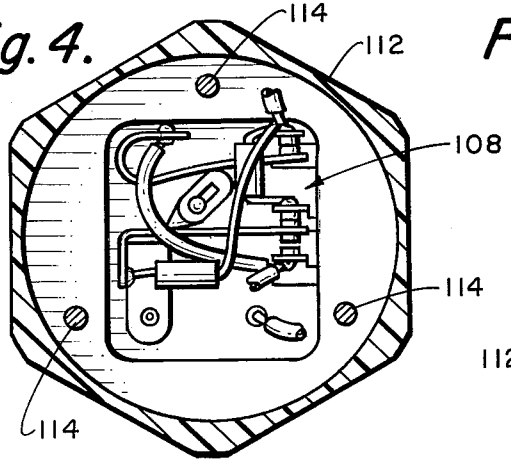
FIG. 4 is a cross-sectional view taken along line 4—4 of FIG. 1.
Figure 2:
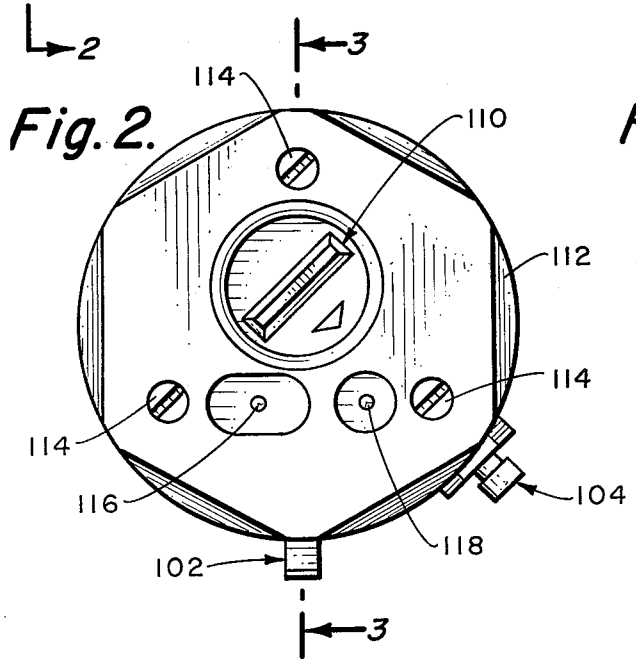
FIG. 2 is an end view of the screwdriver of this invention taken along line 2—2 of FIG. 1.
Figure 3:
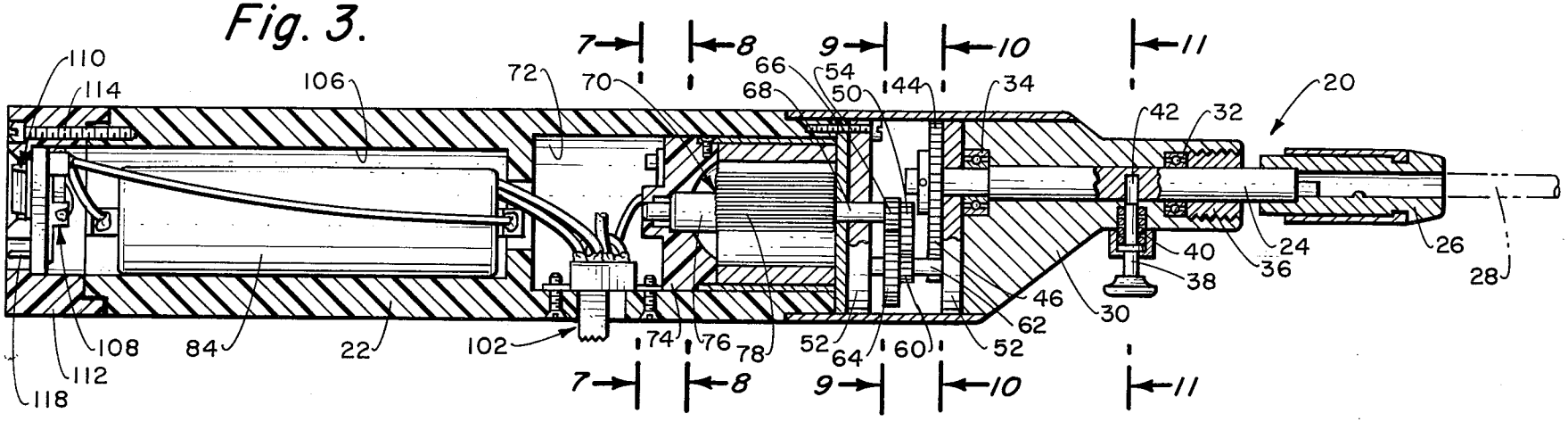
FIG. 3 is a view similar to FIG. 1 but in cross-section taken along the line 3—3 of FIG. 2.
Figure 8:
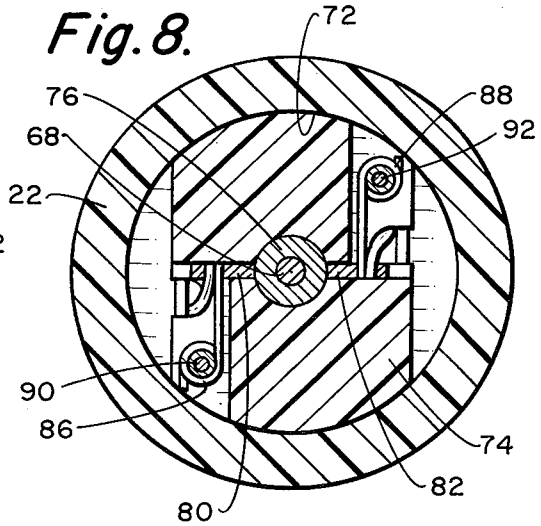
FIG. 8 is a cross-sectional view taken along line 8—8 of FIG. 3.
Figure 7:
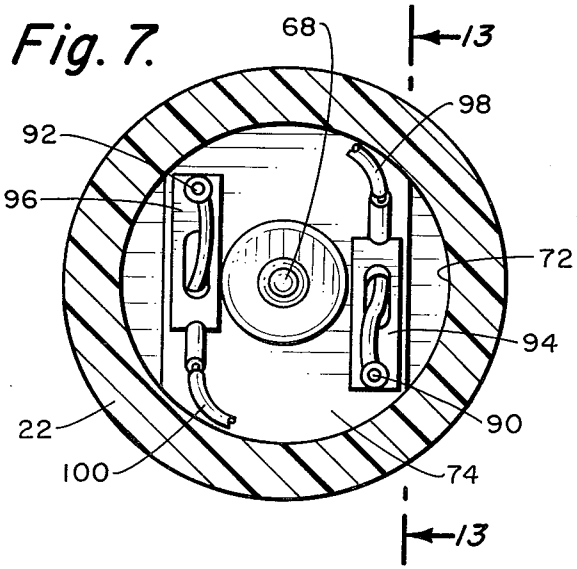
FIG. 7 is a cross-sectional view taken along line 7—7 of FIG. 3.
Figure 6:
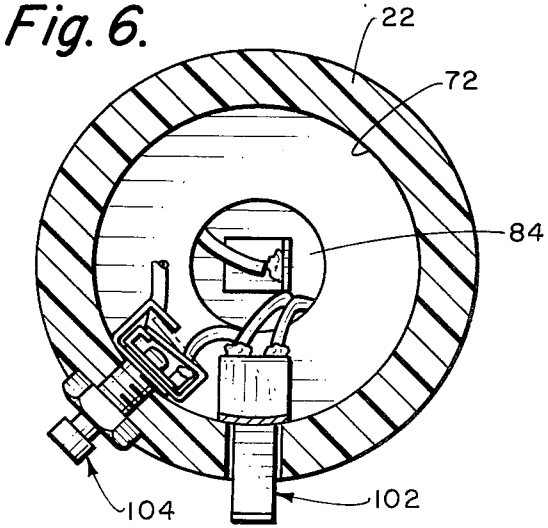
FIG. 6 is a cross-sectional view taken along line 6—6 of FIG. 1.
Figure 9:
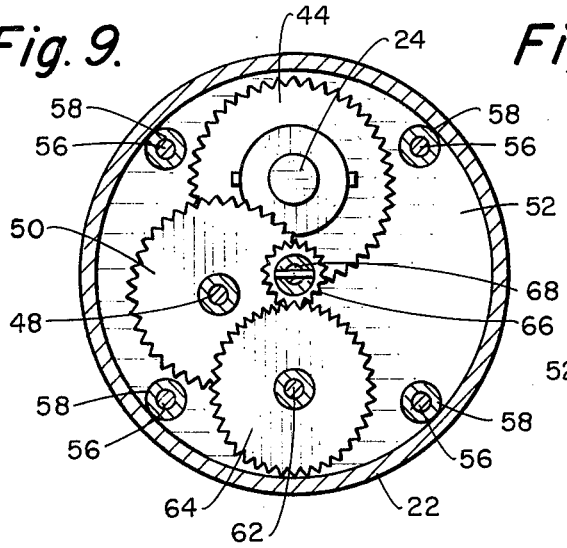
FIG. 9 is a cross-sectional view taken along line 9—9 of FIG. 3.
Figure 10:
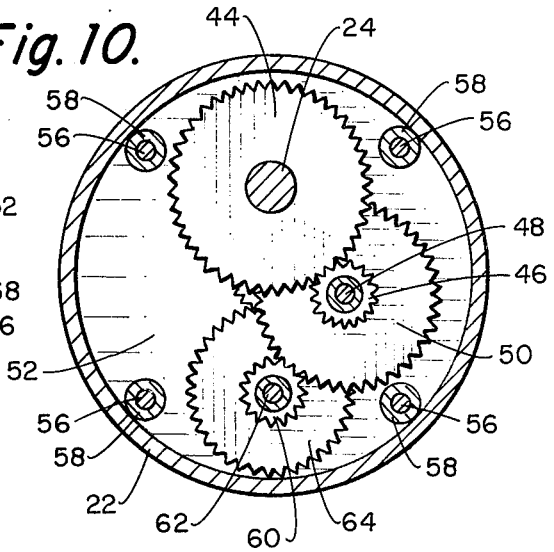
FIG. 10 is a cross-sectional view taken along line 10—10 of FIG. 3.
Figure 11:
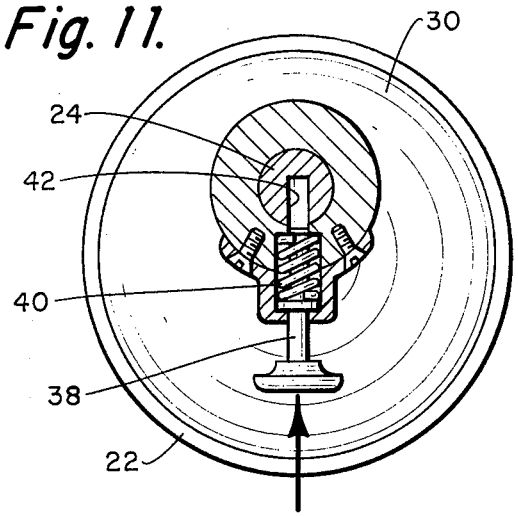
FIG. 11 is a cross-sectional view taken along line 11—11 of FIG. 3.

Referring particularly to the drawings, there is shown in FIG. 1 the screwdriver 20 of this invention which is constructed of a basically cylindrical shaped housing 22. A drive shaft 24 extends from the forward end of the housing 22 and is connectable to a tool head connector 26. The tool head connector 26 is adapted to receive in an interlocking manner a tool head 28. The tool head 28 will normally take the form of a conventional flat screwdriver head, but can also take the form of other screwdriver heads, such as a phillips head, or can take the form of other types of tools.

The drive shaft 24 is rotatably mounted within a plug 30 by means of bearing assemblies 32 and 34. The bearing assembly 32 is held in position by means of an insert 36 which is threadably secured within the plug 30.

Mounted within the plug 30 is a locking pin 38. A coil spring 40 surrounds a portion of the pin 38 and is located within an appropriate recess formed within the plug 30. The spring 40 exerts a continuous bias against the pin 38 tending to locate the pin 38 in an outward position.

Figure 12:
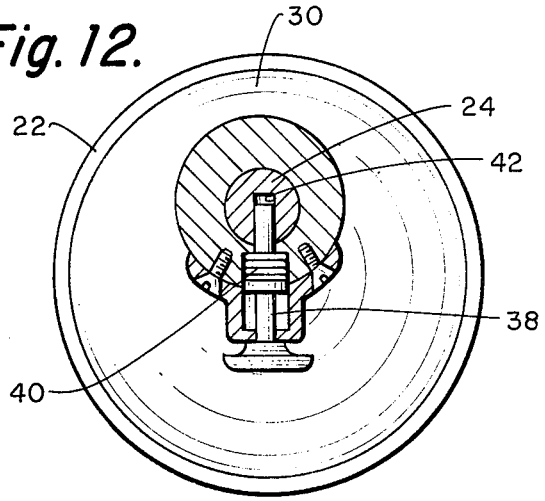
FIG. 12 is a view similar to FIG. 11, but showing the drive shaft locking in the activated position.
Figure 13:
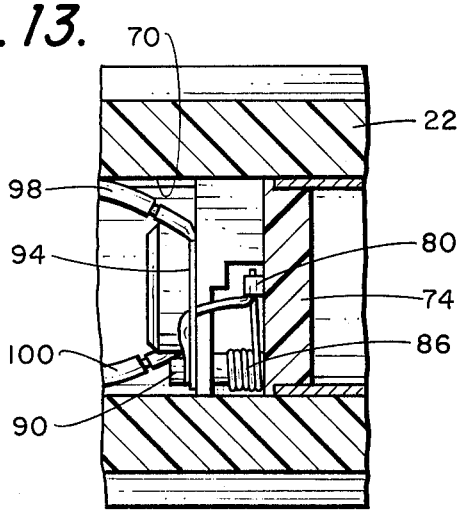
FIG. 13 is a cross-sectional view taken along line 13—13 of FIG. 7.

The drive shaft 24 includes a recess 42 which is capable of receiving the pin 38. When the pin 38 is moved against the bias of the spring 40 so that the inner end of the pin 38 cooperates within the recess 40 as shown in FIG. 12 of the drawings, the drive shaft 24 is then fixedly secured to the plug 30. This permits the screwdriver 20 to be employed in a conventional manual manner with the person using the screwdriver applying the torque against the housing 22 which, in turn, is transferred through the plug 30 directly to the drive shaft 24. There will be no torque transferred to the inner mechanism of the screwdriver 20. This type of arrangement is preferable if, for some reason, a high degree of torque is needed due to a bolt or screw being stuck or frozen in position, or difficult to maneuver.

The inner end of the drive shaft 24 is fixedly secured to a first gear 44. The first gear 44 is operably connected to a second smaller sized gear 46. Gear 46 is mounted on a shaft 48. The shaft 48 has also fixed thereto an enlarged idler gear 50. The ends of the shaft 48 are rotatably supported with respect to a gear housing 52. One side of the gear housing 52 abuts the plug 30 with the other side of the gear housing 52 being fastened by bolts 54 to the housing 22. The gear housing 52 is composed of two separate spaced apart plates which are interconnected together by means of bolts 56. Each of the bolts 56 are surrounded by a spacer 58. With the bolts 56 tightened between the two parts of the housing 52 and in abutting contact to the spacers 58, a solid integral housing 52 is formed which has an open center section within which is located the gearing assembly which includes gears 44, 46 and 50.

Gear 50 is driven by a small gear 60 which is fixedly secured to a shaft 62. Also fixedly secured on shaft 62 is a second large sized idler gear 64. The shaft 62 is rotatably mounted within the housing 52. Gear 64 is rotatably driven by a small sized drive gear 66 which is fixedly secured to the motor drive shaft 68. The driver shaft 68 is to be rotated by a motor assembly 70 which is mounted within an appropriately formed cavity 72 within the housing 22.

The motor assembly 70 includes an end cap 74. Mounted on the motor drive shaft 68 is a band 76. This band 76 is electrically conductive and is electrically connected to the coils 78 of the motor assembly 70. Located within the end cap 74 are a pair of shoes 80 and 82 located diametrically opposite each other with respect to the band 76. The shoes 80 and 82 are to be in continuous contact with the band 76, although the band 76 is to be rotating when operating with respect to the end cap 74. The shoes 80 and 82 are adapted to transmit electrical energy from the battery 84 to the coils 78.

The shoe 80 is biased by a spring 86 toward the band 76. The shoe 82 is similarly biased by a spring 88 toward the band 76. The spring 86 is mounted by a pin 90 to the end cap 74. The spring 88 is mounted by a pin 92 to the end cap 74. Each of the springs 86 and 88 are electrically conducted and are adapted to conduct electricity from their respective shoes 80 and 82 to a respective electrical conducting plate 94 and 96. These plates 94 and 96 are attached to the outer surface of the end cap 74. Plates 94 and 96 are connected to electrical conducting wires 98 and 100, respectively. The wires 98 and 100 are appropriately connected to an operating switch assembly which comprises a pair of switches 102 and 104. Both switches 102 and 104 are mounted through appropriate aperture means within the housing 22. Switches 102 and 104 are electrically connected in conjunction with the battery 84. The battery 84 is mounted within a chamber 106 formed within the housing 22.

The switch assembly 102 is a two position switch and when in one position causes the electricity from the battery 84 to be conducted to drive the motor assembly 70 in a clockwise direction. If the switch 102 is in the other position, the motor assembly 70 is driven in the counterclockwise direction. Therefore, by operation of the switch 102, the screwdriver 20 of this invention can be employed to either tighten screws or bolts or loosen screws or bolts.

Switch 102 is to be placed in the position to achieve the desired driving direction. At this particular time the unit is not operating. Upon depressing of switch 104, the screwdriver 20 then operates and the drive shaft 24 is driven in the desired direction. It is to be noted that the switches 102 and 104 are located on one particular side of the housing 22. It is also to be noted that the drive shaft 24 is off-set from the longitudinal center axis of the housing 22 and is located nearest one particular side of the housing 22. The switches 102 and 104 are positioned substantially opposite this one side of the housing. The reason for this is that if the device is placed on a table or other planar supporting surface, because of the unbalance due to the off-setting of the drive shaft 24, the device 20 will always rest on the one side which is nearest the drive shaft 24. This means that the switches 102 and 104 will always be located in a displaced position from the table or planar supporting surface. This will prevent accidental activation of the device 20 when not in use.

The battery 84 is constructed in a conventional manner with the only difference being the size of the battery. The size has been specifically designed in order to be readily located within the chamber 106.

The battery 84 is electrically connected to a switch plate 108. The switch plate 108 includes a switching mechanism 110. This plate 108 is fixedly mounted to a cap 112 which, in turn is fixedly secured by bolts 114 to the housing 22. Also included within the plate 108 are a pair of electrically connecting electrical terminals 116 and 118. The switch 110 can be moved to three different positions and in one position there will be no electrical energy being conducted to the motor assembly 70, and in another position there will be electrical energy conducted to the motor assembly 70 and in the third position there will be no electrical energy conducted to motor assembly 70 but will be conducted to the terminals 116 and 118. In other words, a separate auxiliary device may be plugged into terminals 116 and 118 and driven electrically by means of the battery 84. When the device is not in use, the switch 110 is located in the non-operating position.

What is claimed is:

1. A battery operated screwdriver comprising:

an elongated cylindrical housing having a longitudinal center axis;

a battery and motor assembly mounted within said housing;

a drive shaft mounted within said housing, said drive shaft being rotationally driven by said motor assembly and being connectable to a tool head, said drive shaft being spaced from said longitudinal axis to facilitate use in inaccessible locations;

an operating switch assembly mounted on said housing, said operating switch assembly including a first switch and a second switch, said first switch being movable to different positions to place said drive shaft in either a clockwise operating mode or a counterclockwise operating mode, said second switch being operable to activate the rotational movement of said drive shaft;

said operating switch assembly being located on an exterior wall of said housing and being spaced from said longitudinal axis in a direction generally opposite to that of from said drive shaft, whereby with said screwdriver placed at rest on a planar supporting surface the weight distribution of said screwdriver causes said housing to always be located in a particular position with said switch assembly being spaced from said planar supporting surface.

2. The screwdriver as defined in claim 1 wherein:

a drive shaft locking device is connected to said housing and said drive shaft, said drive shaft locking device being movable between a locking position and an unlocking position, whereby with said locking device in said locking position the said drive shaft is fixed to said housing, spring means connected to said locking device normally biasing said locking device to said unlocking position, whereby said screwdriver can then be used in a conventional manual manner.

3. A battery operated screwdriver comprising:

an elongated cylindrical housing having a longitudinal center axis;

a battery and motor assembly mounted within said housing, said housing being basically cylindrical in configuration, the physical weight of said housing being unevenly distributed, whereby upon said housing being placed on a planar supporting surface said housing will always pivot to rest in a particular position on said planar supporting surface;

a drive shaft mounted within said housing;

an operating switch assembly mounted on said housing, said operating switch assembly including a first switch and a second switch, said first switch being movable to different positions to activate said motor assembly in either a forward operating mode or a reverse operating mode, said second switch being operable to activate the operation of said motor assembly;

said operating switch assembly being located on an exterior wall of said housing and being spaced from said longitudinal axis in a direction generally opposite to that of from said drive shaft, whereby with said screwdriver placed at rest on a planar supporting surface the weight distribution of said screwdriver causes said housing to always be located in a particular position with said switch assembly being spaced from said planar supporting surface.

4. The screwdriver as defined in claim 3 wherein:

a drive shaft locking device is connected to said housing and said drive shaft, said drive shaft locking device being movable between a locking position and an unlocking position, whereby with said locking device in said locking position the said drive shaft is fixed to said housing, spring means connected to said locking device normally biasing said locking device to said unlocking position, whereby said screwdriver can then be used in a conventional manual manner.

5. The screwdriver as defined in claim 4 wherein:

said drive shaft being rotationally driven by said motor assembly, said drive shaft being connectable to a tool head and being spaced from said longitudinal center axis, whereby the location of said drive shaft produces the uneven weight distribution of said housing.

* * * * *